US006557198B1

(12) United States Patent
Gladney et al.

(10) Patent No.: US 6,557,198 B1
(45) Date of Patent: May 6, 2003

(54) MATTRESS AND BED ASSEMBLY PROVIDING AN ENLARGED SLEEPING SURFACE AREA

(75) Inventors: Rick F. Gladney, Fairburn, GA (US); Kurtis A. Ling, Alpharetta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 09/680,259

(22) Filed: Oct. 5, 2000

(51) Int. Cl.[7] ..... A47C 27/00
(52) U.S. Cl. ..... 5/690; 5/400; 5/411; 5/659
(58) Field of Search ..... 5/400, 401, 402, 5/411, 690, 691, 701, 717, 739, 728, 659, 661, 8, 903

(56) References Cited

U.S. PATENT DOCUMENTS

| | | | | | |
|---|---|---|---|---|---|
| 871,871 | A | * | 11/1907 | Hirschman | 267/92 |
| 2,661,486 | A | * | 12/1953 | Roher | 5/248 |
| 2,826,765 | A | | 3/1958 | Entwistle | |
| 2,847,685 | A | * | 8/1958 | Freedlander | 5/659 |
| 3,022,523 | A | * | 2/1962 | Schmutz | 5/239 |
| 3,125,768 | A | | 3/1964 | Rickert | |
| 3,512,191 | A | * | 5/1970 | Wall et al. | 297/218.2 |
| 3,737,925 | A | * | 6/1973 | Oxford | 5/131 |
| 3,837,020 | A | * | 9/1974 | Bosch | 5/411 |
| 4,155,131 | A | * | 5/1979 | Harris et al. | 5/207 |
| 4,169,294 | A | * | 10/1979 | Harris | 5/207 |
| 4,532,662 | A | * | 8/1985 | Sama | 5/679 |
| 4,651,370 | A | * | 3/1987 | Vitale | 5/407 |
| 5,289,600 | A | * | 3/1994 | Schermel | 5/201 |
| 5,379,470 | A | * | 1/1995 | Morgan | 5/400 |
| 5,819,349 | A | * | 10/1998 | Schwartz | 5/722 |
| 6,243,900 | B1 | * | 6/2001 | Gladney et al. | 5/720 |

FOREIGN PATENT DOCUMENTS

| | | |
|---|---|---|
| GB | 458036 | 12/1936 |

OTHER PUBLICATIONS

Wep page found at http://www.royal–pedic.com/html/custom.cfm.*
Web Page found at http://www.yourdesignmattress.com/aboutus.html.*
Web page found at http://www.kentwebnet.com/specialist–beds/index.htm.*

* cited by examiner

*Primary Examiner*—Michael F. Trettel
(74) *Attorney, Agent, or Firm*—Ropes & Gray

(57) ABSTRACT

A bed assembly provides an enlarged sleeping surface area as compared to a standard Queen sized bed. Specifically, in the disclosed bed assemblies, the sleeping surface area is about 64 inches to about 68 inches wide and about 77 inches to about 82 inches long. This can be accomplished by providing both a mattress and a foundation having the appropriate, enlarged sleeping surface area, or by combining an enlarged mattress with a foundation having at least one standard Queen size surface. The mattress and foundation can be fit into a bed frame made of a suitable size to fit the bottom surface of the foundation (i.e., either "enlarged" or standard Queen size). Preferably, the enlarged sleeping surface of the bed may be between about 65 inches to about 67 inches wide and about 78 inches to about 80 inches long. This enlarged sleeping surface area provides a more comfortable and restful sleep for two occupants.

20 Claims, 2 Drawing Sheets

MATTRESS AND BED ASSEMBLY PROVIDING AN ENLARGED SLEEPING SURFACE AREA

BACKGROUND OF THE INVENTION

This invention relates to mattresses and foundations for beds, and particularly to mattresses and/or foundations that provide an enlarged sleeping surface area as compared to a conventional Queen sized bed.

Standard bed sizes (American National Standard 2357.1-1981) published by the International Sleep Association are as follows:

| | |
|---|---|
| Twin: | 38 inches by 74.5 inches; |
| Twin Extra-Long: | 38 inches by 79.5 inches; |
| Double: | 53 inches by 74.5 inches; |
| Double Extra-Long: | 53 inches by 79.5 inches; |
| Queen: | 60 inches by 79.5 inches; |
| King: | 76 inches by 79.5 inches; |
| California King: | 72 inches by 83.5 inches. |

Typically, the twin bed size is suitable for individual children, and the double bed size is suitable for individual adults. When two people intend to sleep in a single bed, a double bed or a Queen size bed cannot always comfortably accommodate them, particularly if at least one of the people is of relatively large stature or if at least one of the people is a relatively light sleeper or a restless sleeper. Because of the close proximity, movement by one occupant of the bed is transferred to and tends to wake up or keep up the other bed occupant. While appropriate selection of the inner core spring construction and padding may help reduce this transfer of motion, beds of such construction tend to be less comfortable to users.

Generally, because of their larger sizes, two people can be comfortably accommodated in King sized or California King sized beds. These beds, however, are so large that they do not always comfortably fit inside the bedroom and/or they do not leave sufficient space in the room to accommodate other furniture that is typically desired in a bedroom. Moreover, the increased costs of King sized and California King sized mattresses, foundations, bed frames, and bedding make these very large bed sizes disadvantageous.

Thus, there is a need for a mattress, foundation, and/or bed assembly that provides a reduced transfer of motion between bed occupants and an enlarged sleeping surface area as compared to conventional Queen sized beds but that is not so large as to overfill or cramp the available space in conventional sized bedrooms.

SUMMARY OF THE INVENTION

This invention relates to a bed assembly that provides an enlarged sleeping surface area as compared to a standard Queen sized bed. Particularly, the bed assembly according to the invention has a sleeping surface area of about 64 inches to about 68 inches wide and about 77 inches to about 82 inches long. This enlarged width is between the standard sizes for Queen size and King size beds.

One embodiment of the invention relates to a mattress, comprising: a top surface; a bottom surface; and an inner core between the top surface and the bottom surface, wherein the mattress is about 64 inches to about 68 inches wide and about 77 inches to about 82 inches long. In this specification, a mattress having the dimensions described above also will be called an "enlarged" mattress.

In another aspect of the invention, the above-described enlarged mattress can be used with a foundation for supporting the mattress. In this aspect of the invention, the foundation (e.g., a box spring) comprises: a top support surface; a bottom support surface; and an inner support structure between the top support surface and the bottom support surface, wherein the foundation is about 64 inches to about 68 inches wide and about 77 inches to about 82 inches long. A foundation having these dimensions also will be referred to in this specification as having an "enlarged" size. The enlarged mattress and enlarged foundation can be used together, optionally with an independent base frame unit of appropriate size, to provide a bed assembly.

In another embodiment of the invention, a mattress according to the invention, having an enlarged sleeping surface area as compared to a standard Queen sized mattress, is used in combination with a foundation having a standard Queen size. This can be accomplished in various different ways. For example, in one specific embodiment, the enlarged mattress itself includes a rigid bottom member, integrally formed as part of the mattress, having a width of about 64 inches to about 68 inches and a length of about 77 inches to about 82 inches. The rigid bottom member is used to support the edge portions of the mattress that extend over the sides of a standard Queen size foundation. Because of this rigid bottom member, the enlarged mattress according to this aspect of the invention provides only one sleeping surface (i.e., it is a "one-sided" mattress). In other words, because of the rigid bottom member, this enlarged mattress cannot be flipped over to provide a second sleeping surface. In another specific embodiment, a two-sided enlarged mattress is used with a standard Queen sized foundation, and a substantially flat, rigid support is provided between the mattress and the foundation. Advantageously, this substantially flat, rigid support will have an overall width of about 64 inches to about 68 inches and a length of about 77 to about 82 inches, to support the overhanging side edges of the enlarged mattress. If desired, the substantially flat rigid support may be constructed from two or more flat, rigid supports, and preferably the substantially flat, rigid support includes a first board having a width of about one half the width of the enlarged mattress and a length substantially the same as the length of the enlarged mattress, and a second board having a width of about one half the width of the enlarged mattress and a length substantially the same as the length of the enlarged mattress. These two boards are centered, side-by-side, such that a combined width of the first board and the second board substantially correspond to the width of the enlarged mattress.

In yet another aspect of the invention, a foundation is provided having a bottom surface that fits into a standard Queen sized bed frame and an enlarged upper surface that corresponds to the width of the enlarged mattresses according to the invention. This foundation comprises: a top support surface having a width of about 64 inches to about 68 inches and a length of about 77 inches to about 82 inches; a bottom support surface having a width of about 58 inches to about 61 inches and a length of about 77 inches to about 82 inches, wherein the top support surface extends outside of the width of the bottom support surface by about 2 inches to about 4 inches on each side of the bottom support surface.

Of course, the mattresses and foundations according to the invention can be used together to form a bed assembly. A base frame member of an appropriate size (depending on the size of the foundation bottom) can be used along with the mattress and foundation to hold the mattress and foundation above the floor.

Also, in all of the above embodiments of the invention, the enlarged surface of the mattress and/or foundation may be between about 65 inches to about 67 inches wide and about 78 inches to about 80 inches long.

BRIEF DESCRIPTION OF THE DRAWINGS

The invention will be better understood when considered in conjunction with the following detailed description and the appended drawings briefly described below.

DETAILED DESCRIPTION OF THE INVENTION

This invention will be described in more detail below, in conjunction with the attached figures that illustrate various specific and preferred embodiments of the invention. These specific and preferred embodiments are provided to illustrate the invention, not to limit it. In the figures and this specification, the same reference number will be used consistently throughout to refer to the same part.

Figure 1:
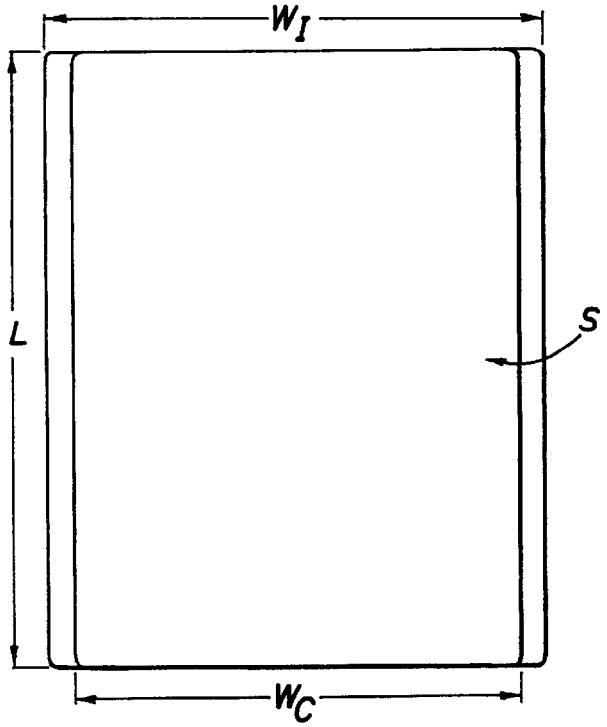
FIG. 1 generally illustrates the differences between the mattress or foundation according to the invention and a standard Queen sized mattress or foundation.

FIG. 1 illustrates an overhead view showing the top surface S of a mattress or foundation member according to the invention. In FIG. 1, the dimension $W_C$ illustrates the width of a conventional Queen sized mattress and foundation (about 59–60 inches wide), whereas the dimension $W_I$ illustrates the enlarged width of a mattress, and/or foundation according to the invention. The mattress and/or foundation according to the invention has a width of about 64 to about 68 inches, with about 65 inches to about 67 inches being preferred, and about 65.5 inches to about 66 inches being particularly preferred. The enlarged mattress and/or foundation according to the invention will have a length (dimension "L" in FIG. 1) of about 77 inches to about 82 inches, and advantageously between about 78 inches and about 80 inches. If desired, the mattress and/or foundation according to the invention can have a standard Queen sized length of about 79.5 to about 80 inches. Also, while the mattresses according to the invention can have any suitable thickness, like conventional mattresses, the inner spring mattresses according to the invention typically have a riser height or thickness of about 6 inches to about 9 inches.

Figure 2:
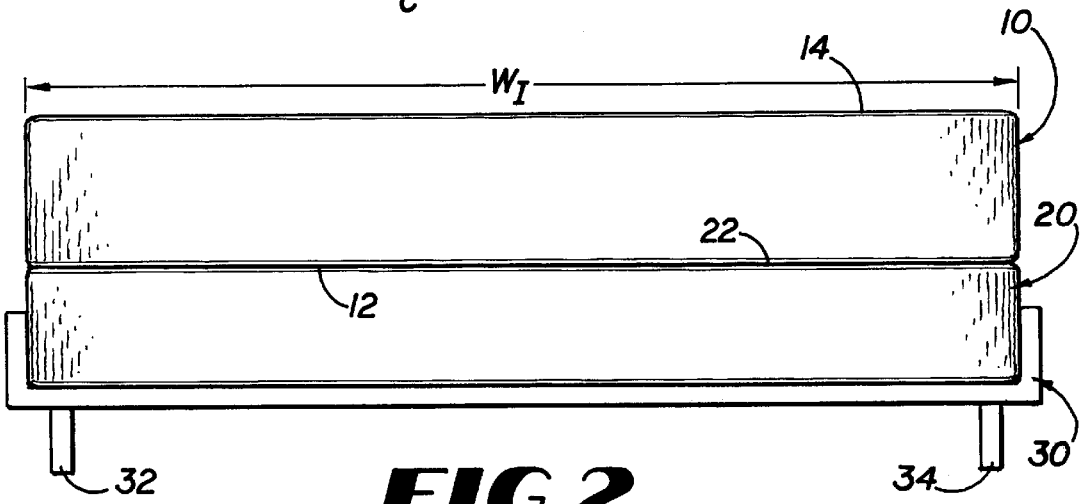
FIG. 2 illustrates an end view of a bed assembly according to the invention wherein both the mattress and foundation are an "enlarged" size.

In a first embodiment of the invention, an end view of which is illustrated in FIG. 2, both the mattress 10 and the foundation 20 are constructed of the enlarged width $W_I$ according to this invention. The top surface 22 of the foundation 20 supports the bottom surface 12 of the mattress 10 across the entire width $W_I$.

The mattress 10 may be of any conventional construction, provided it has the enlarged width $W_I$ described above. For example, the mattress 10 may have a conventional inner spring mattress construction, comprising two identical sleep surfaces (the top surface 14 and the bottom surface 12), with an intermediate inner core assembly of wire springs covered with a padding at the top surface 14 and the bottom surface 12. This entire assembly may be encased within a ticking (optionally quilted) that is sewn together around its periphery to a border (boxing). Like conventional inner spring mattresses, when a bed assembly according to the invention is provided with a two-sided mattress 10 as illustrated in FIG. 2, the mattress 10 may be periodically flipped over and/or rotated in order prevent, reduce, minimize, delay, and/or counteract sag, deflection, and/or compaction of the interior core support and padding materials. Left unchecked, the deflection and/or compaction of the padding material can become permanent and/or difficult to reverse.

The foundation 20 according to the invention also may be of a conventional construction, such as a conventional box spring construction, only having an enlarged surface area to support the enlarged mattress 10. Typically, foundations are composed of an assembly of wire springs or non-resilient structure attached to a rigid frame located at the bottom, and covered with a padded upper surface. The entire assembly may be encased within a ticking that is sewn (closed) together around its periphery to a border (boxing) and affixed to the underside of the rigid bottom frame. Often, a dust cover made of light plastic film or a like material is applied to the underside of the rigid bottom frame.

The foundation 20 and mattress 10 may be supported in a bed frame 30 having legs 32 and 34 to raise the foundation 20 to a desired level above the floor. The overall bed assembly also may include conventional slat supports (not shown) extending in the width direction at one or more locations along the length to help support the foundation 20 on the frame 30, as well as a conventional headboard and/or footboard (also not shown). In the bed assembly illustrated in FIG. 2, all three main elements (i.e., the mattress 10, the foundation 20, and the bed frame 30) have an appropriate width to provide and/or accommodate the enlarged sleeping surface area and width $W_I$ of the bed assembly.

As other alternatives, the mattress 10 may have a variety of other conventional interior core constructions, including latex foam, polyurethane foam, or fiber pads, or the inner core may be composed of a bladder member that holds water, air, gels, or other gas, liquid, or semisolid support materials. The skilled artisan will be able to adapt these conventional mattress constructions to have an enlarged sleeping surface area according to the invention through routine experimentation. Additionally, the skilled artisan will be able to produce and construct a suitable foundation and/or bed frame to support the specifically selected mattress construction through routine experimentation.

Figure 3:
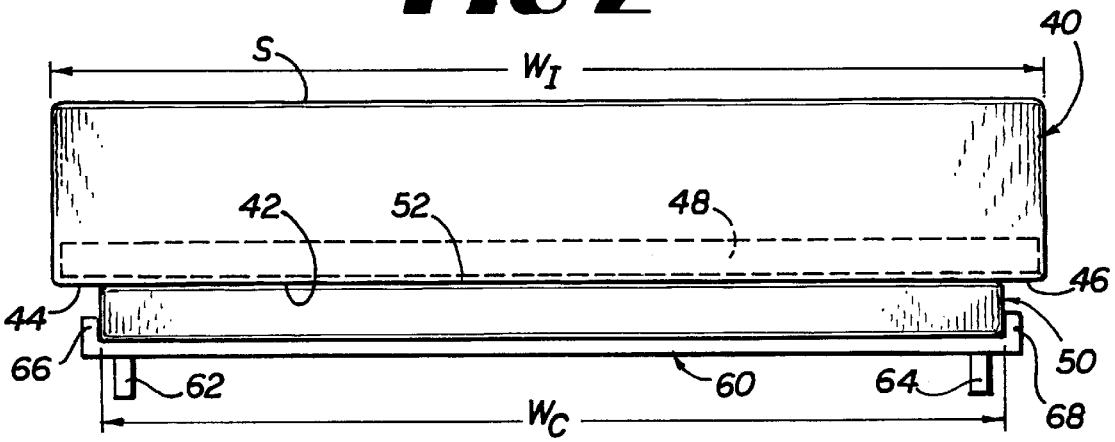
FIG. 3 illustrates an end view of a bed assembly according to the invention wherein the mattress is an "enlarged" size and the foundation is a conventional Queen size.

Another embodiment of the invention is illustrated in FIG. 3. In this embodiment, a mattress 40 having an enlarged size according to the invention (width $W_I$) is supported by a foundation member 50 of conventional Queen size (outside width $W_C$). The bottom surface 42 of the mattress 40 is supported by the top surface 52 of the foundation 50. Again, the mattress 40 and foundation 50 can be supported above the floor level using a bed frame 60 having legs 62 and 64. In this instance, the bed frame 60 is of conventional size and construction for holding and supporting a foundation member 50 of conventional Queen size (inside width $W_C$).

In this version of the bed assembly according to the invention, as shown in FIG. 3, the two side edges 44 and 46 of the mattress 40 extend over the two side edges of the foundation 50 (i.e., the mattress 40 is wider than the foundation 50). Typically, this overhanging width is about 2 to about 4 inches on each side, and preferably about 3 inches on each side. In order to support the mattress edges 44 and 46, the mattress 40 includes a rigid, preferably flat, bottom member 48 integrally provided within the mattress 40. Although some variance may be possible, preferably this rigid bottom member 48 has a width corresponding to the width of the mattress 40 (about 64 inches to about 68 inches) and a length corresponding to the length of the mattress (typically about 77 inches to about 82 inches). The rigid bottom member 48 may be made from wood, particle board, or any other suitable rigid support material, and it may be made from any suitable number of independent pieces, provided the overall rigid bottom member provides adequate strength to support the mattress and users. The rigid bottom member 48 also need not be a continuous solid sheet of material (i.e., open spaces may be provided in the interior of member 48).

The inner core of the mattress 40, above the rigid bottom member 48, may be of conventional mattress construction, including springs, padding, foams, bladders, etc., as described above. Also, the side members 66 and 68 of the bed frame 60 may be constructed to help support the overhanging edges 44 and 46 of the mattress 40, although this is not a requirement (i.e., the foundation 50 and mattress 40 can be held by a conventional Queen sized bed frame that would not directly support the side edges 44 and 46 of the mattress 40, as illustrated in FIG. 3).

The mattress 40 of the invention as illustrated in FIG. 3, quite apparently, provides only a single sleeping surface (top surface S). In other words, this mattress 40 cannot be flipped over so that the user could alternately sleep on the bottom surface 42 because the rigid bottom member 48 makes the bottom surface 42 uncomfortable for sleeping. This fact, however, provides some significant advantages to the structure shown in FIG. 3. For example, because the mattress 40 has only one sleeping surface and the bottom surface 42 remains rigid for supporting purposes, about 50% less padding material may be used in the inner core of the one-sided mattress 40 of FIG. 3 as compared to a conventional two-sided mattress construction. Because less padding is used, there is less compaction of the padding, and consequently, less sag and deflection in the mattress 40 of FIG. 3 (sag and deflection can interfere with a mattress' intended function of providing a supportive and resilient sleep surface). The user also is not exposed to the inconvenience of having to periodically flip over the mattress 40 (although occasional 180 degree rotations of the mattress 40 may still be beneficial for reducing some sagging, deflection, and compaction).

The bed assembly according to the embodiment illustrated in FIG. 3 also is advantageous because the enlarged mattress 40 can be used with a conventional Queen sized foundation 50 and bed frame 60. This would enable one to obtain the advantages of the enlarged mattress 40 without the need to also spend money obtaining an enlarged foundation and/or bed frame like those shown in FIG. 2.

Figure 4:
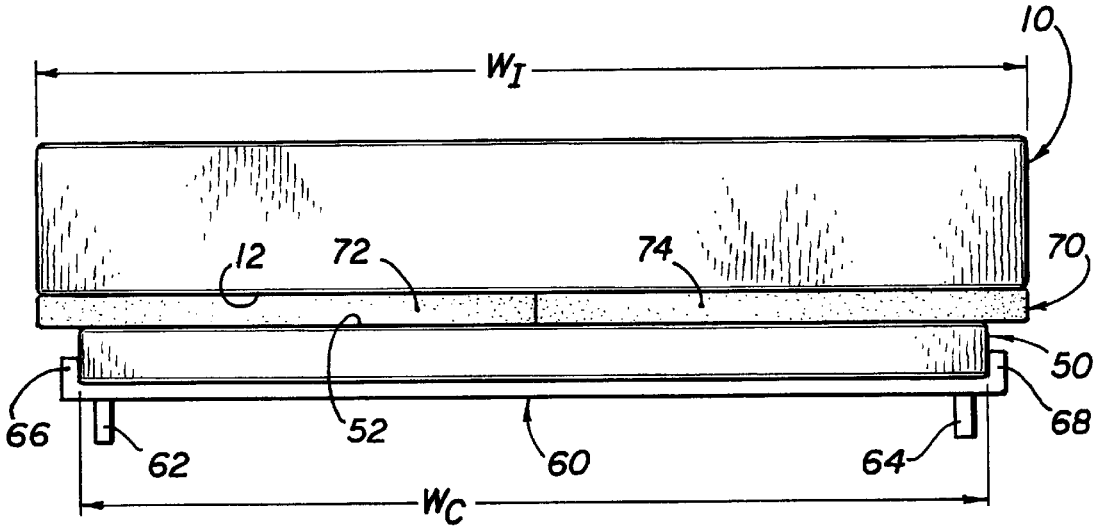
FIG. 4 illustrates an end view of another bed assembly according to the invention wherein the mattress is an "enlarged" size, the foundation is a conventional Queen size, and a rigid support is provided between the mattress and foundation.

FIG. 4 illustrates another embodiment of the invention wherein an enlarged two-sided mattress 10 of width $W_I$ according to the invention can be coupled with a foundation 50 and bed frame 60 of conventional Queen size (width $W_C$). In this embodiment of the invention, a substantially flat, rigid support-member 70 is provided between the lower surface 12 of a two-sided enlarged mattress 10 and the top surface 52 of a conventional Queen size foundation. In the illustrated embodiment, the substantially flat, rigid support member 70 has an overall width of about 64 to about 68 inches (which corresponds to the overall width of the mattress 10), and an overall length of about 77 inches to about 82 inches (which corresponds to the overall length of the mattress 10 and the foundation 50). Preferably, the substantially flat, rigid support member 70 is composed of two support boards 72 and 74 (also called "bunkie boards"), oriented side by side such that the first board 72 has a width of about one half the overall width of the mattress 10 and a length substantially the same as the length of the mattress 10, and the second board 74 has a width of about one half the overall width of the mattress 10 and a length substantially the same as the length of the mattress 10. When located side by side, the first board 72 and the second board 74 have a combined width substantially corresponding to the overall width of the mattress 10 and overhang the edges of the foundation 50. The support boards 72 and 74 may be made of plywood, particle board, or any other suitable rigid support material.

The embodiment of the invention illustrated in FIG. 4 differs from the embodiment illustrated in FIG. 3 in that the substantially flat rigid member 70 is independent from and external to the mattress 10 (in the embodiment of FIG. 3, the rigid member 48 was integrally formed as part of the mattress 40). While the embodiment of FIG. 4 includes two boards 72 and 74 arranged side by side, other arrangements are possible without departing from the invention provided that the boards can be adequately held in place (e.g., four boards arranged in a 2×2 array). Also, if desired, the edges 66 and 68 of the bed frame 60 can help support the overhanging edges of the boards 72 and 74.

Figure 5:
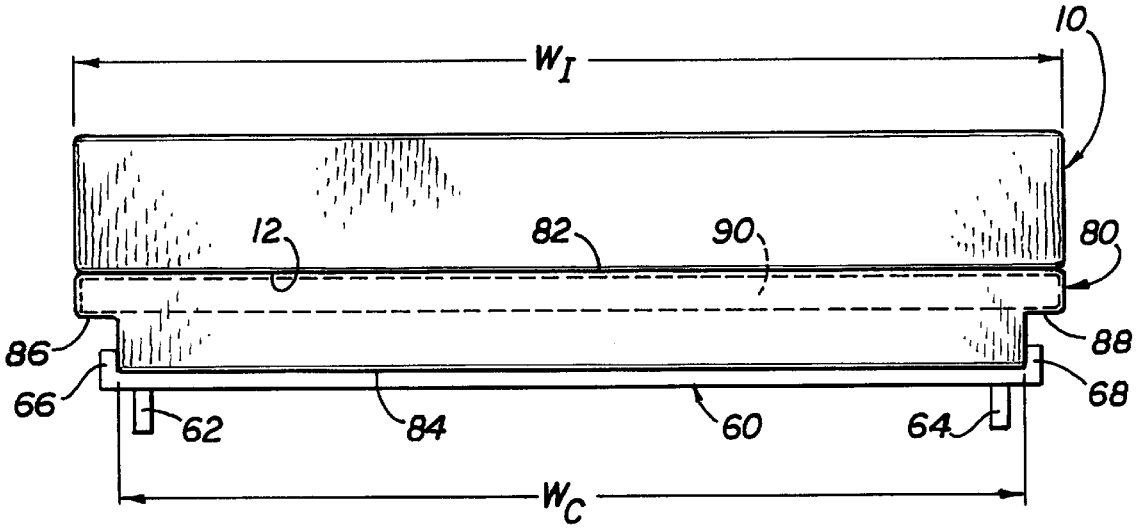
FIG. 5 illustrates an end view of another bed assembly according to the invention wherein the foundation has one "enlarged" surface and one conventional Queen size surface.

FIG. 5 illustrates another embodiment of the invention wherein an enlarged two-sided mattress 10 having a width of $W_I$ is used with a bed frame 60 of conventional Queen size (width $W_C$). In this embodiment of the invention, the foundation member 80 has an enlarged upper surface 82 (width $W_I$) which supports the lower surface 12 of the mattress 10. However, the lower surface 84 of the foundation 80 has a conventional Queen size (width $W_C$) so that the foundation 80 fits into the conventional Queen sized bed frame 60. Again, if desired, the edges 66 and 68 of the bed frame 60 can be used to support the overhanging edges 86 and 88 of the foundation 80.

The foundation 80 can be constructed of conventional materials used for making box springs or other bed foundations, provided the top surface 82 in some manner "mushrooms" outward to support the full width $W_I$ of the enlarged mattress 10. Those of ordinary skill in the art will be capable of making a suitable foundation 80 with this "mushroom" configuration through routine experimentation. The foundation 80 includes a rigid, preferably flat, top member 90 integrally provided within the foundation 80. Although some variance may be possible, preferably this rigid top member 90 has a width corresponding to the width of the mattress 10 (about 64 inches to about 68 inches) and a length corresponding to the length of the mattress (typically about 77 inches to about 82 inches). The rigid top member 90 may be made from wood, particle board, or any other suitable rigid support material, and it may be made from any suitable number of independent pieces, provided the overall rigid top member provides adequate strength to support the mattress and users. The rigid top member 90 also need not be a continuous solid sheet of material (i.e., open spaces may be provided in the interior of member 90).

Of course, in the embodiments of the invention illustrated in FIGS. 4 and 5, the one-sided mattress 40 illustrated in FIG. 3 also can be used without departing from the invention, although it is not necessary. As described above, because of the reduced amount of padding, use of the one-sided mattress 40 shown in FIG. 3 has an advantage of reduced sag, deflection, and compaction as compared to use of a conventional two-sided mattress construction that has a larger amount of padding.

The enlarged mattresses and bed assemblies according to this invention have been found to significantly reduce motion transferred from movement of one person on the mattress to another. For testing purposes, the motion transfer is quantified by measuring the motion transferred from a standardized energy source to a mannequin that represents a human of average body size and weight resting on the mattress surface. In one test procedure, the standardized energy source is a standard rollator (ASTM F1566) that acts on one lateral side of the mattress, and the horizontal and vertical movement induced on a mannequin positioned on the other lateral side of the mattress is measured. Several tests are run over time and the data averaged to produce the transferred motion values.

The amplitude of movement created and transferred to the mannequin will vary, depending on the type of mattress and box spring foundation used. A woven wire inner spring mattress will transfer motion differently than a marshal coil-type mattress, although both types of mattress constructions can be used according to the invention. The types of box springs used (e.g., continuous wire or module) also will affect the motion transferred, but again, both types can be used in foundations according to the invention. Those of ordinary skill in the art can select appropriate mattress and foundation constructions to provide the desired and acceptable degree of motion transferred without departing from the invention. The one-sided mattress construction according to the invention has been found to be particularly effective in reducing horizontal and vertical motion in rollator transfer of motion tests.

The standard rollator also can be used to induce and test the amount of compaction (depression and sag) produced in a given mattress construction. The one-sided mattress construction according to the invention has been found to be particularly effective in reducing compaction.

To illustrate the advantages of the present invention over various mattresses in the prior art, the following table contains test data obtained by Simmons Company. The table documents the results of a transfer of motion or do not disturb motion evaluation test, developed by Simmons Company. The motion evaluation was performed on both a standard Queen size mattress and on an enlarged mattress. The transferred motion value was measured for each mattress.

TABLE I

| MATTRESS TYPE | DIMENSIONS | TRANSFERRED MOTION VALUE |
|---|---|---|
| Queen Mattress | 60 inches by 80 inches | 0.196 inches |
| Enlarged Mattress | 66 inches by 80 inches | 0.295 inches |

As shown in the above table, the transferred motion value of the enlarged mattress is 33.6% less than the transferred motion value of the standard Queen size mattress. As the test results indicate, the enlarged mattress is successful at transferring less motion to a sleeping partner.

As is readily evident from the above discussion, the mattresses and bed assemblies according to the invention are advantageous because they provide an enlarged sleeping surface area while providing an overall size more suitable to the user's space requirements. In many embodiments of the invention, the enlarged mattress size can be adapted for use with standard Queen size foundations and bed frames, which saves consumers costs in switching to larger sized beds. The mattresses and foundations according to the invention also are advantageous in that they are less costly to manufacture than standard King sized beds (due to material savings), require less maintenance (turning and rotating), produce less transfer of motion (for a more restful sleep), and provide a more aesthetic appearance when placed on a conventional Queen size foundation (due to minimal visibility of a gap between the foundation and frame).

Those of ordinary skill in the art will appreciate that this specification describes various preferred embodiments of the invention, for purposes of illustration, and that various changes and modifications can be made to the specifically disclosed embodiments without departing from the spirit and scope of the invention as defined in the claims that follow.

We claim:

1. A bed assembly, comprising:

a mattress having a top surface, a bottom surface, and an inner core between the top surface and the bottom surface, wherein the mattress has a width and a length; and a foundation for supporting the bottom surface of the mattress, wherein the foundation has a width that is less than the width of the mattress and a length that is substantially identical to the length of the mattress, wherein the bottom surface of the mattress includes a rigid bottom member integrally provided within the mattress and having a width that is substantially identical to the width of the mattress and a length that is substantially identical to the length of the mattress.

2. A bed assembly according to claim 1, wherein the inner core includes springs.

3. A bed assembly according to claim 1, further including a base frame for supporting the foundation.

4. A bed assembly according to claim 1, wherein the rigid bottom member includes a first board having a width of about one half the width of the mattress and a length substantially the same as the length of the mattress, and a second board having a width of about one half the width of the mattress and a length substantially the same as the length of the mattress.

5. A bed assembly according to claim 4, wherein the first board and the second board are centered, side-by-side, such that a combined width of the first board and width of the second board substantially correspond to the width of the mattress.

6. The bed assembly according to claim 1 wherein the inner core includes a bladder.

7. The bed assembly according to claim 6 wherein the bladder contains a gel.

8. The bed assembly according to claim 6 wherein the bladder holds air.

9. The bed assembly according to claim 6 wherein the bladder holds water.

10. The bed assembly according to claim 1 wherein the inner core includes latex foam.

11. The bed assembly according to claim 1 wherein the inner core includes polyurethane foam.

12. The bed assembly according to claim 1 wherein the inner core includes a fiber pad.

13. The bed assembly according to claim 1 wherein the rigid bottom member is formed of at least one of wood or particle board.

14. The bed assembly according to claim 1 wherein the rigid bottom member is formed of a plurality of independent pieces having adequate strength to support the mattress and at least one user.

15. The bed assembly according to claim 1 wherein the foundation is a standard queen size foundation.

16. The bed assembly according to claim 1 wherein the mattress is adapted for use with a standard queen size foundation.

17. The bed assembly according to claim 1 wherein the mattress is at least one of a marshal coil-type mattress or a woven wire inner spring mattress.

18. The bed assembly according to claim 1 further comprising at least one of a headboard and a footboard.

19. The bed assembly according to claim 1 wherein the mattress is encased with ticking.

20. The bed assembly according to claim 19 wherein the ticking is quilted.

* * * * *